United States Patent [19]

Nolen

[11] 4,330,147

[45] May 18, 1982

[54] LOCKING BAR FOR DOORS FROM THE INSIDE OF DWELLINGS

[76] Inventor: Herbert J. Nolen, 6151 Knightsbridge Dr., Memphis, Tenn. 38115

[21] Appl. No.: 175,913

[22] Filed: Aug. 6, 1980

[51] Int. Cl.[3] ..... E05C 17/54

[52] U.S. Cl. ..... 292/259 R

[58] Field of Search ..... 292/259, 260, 289, 288

[56] References Cited

U.S. PATENT DOCUMENTS

| | | | |
|---|---|---|---|
| 1,889,753 | 12/1932 | Madsen | 292/289 X |
| 2,503,503 | 4/1950 | McGaffey | 292/259 R X |
| 3,352,587 | 11/1967 | Harvey | 292/289 |
| 3,809,417 | 5/1974 | Craig | 292/259 |
| 4,017,104 | 4/1977 | Walker | 292/259 X |
| 4,067,598 | 1/1978 | Mansour | 292/259 R |

*Primary Examiner*—Richard E. Moore

[57] ABSTRACT

This locking bar device enables a person to further secure a door against intruders, when the user is inside of his or her dwelling, and it consists primarily of a pair of brackets installed on the door jambs, that have steel pins, which receive a horizontal bar. The device further includes a key-operated lock, and the structure is such, that it will withstand enormous pressure.

4 Claims, 6 Drawing Figures

LOCKING BAR FOR DOORS FROM THE INSIDE OF DWELLINGS

This invention relates to door locking devices, and more particularly, to a locking bar for doors, from the inside of dwellings, and the like.

It is, therefore, the principal object of this invention to provide a locking bar for doors, from the inside of dwellings, which will serve as a means of preventing a would-be perpetrator from forcefully entering a person's dwelling or other structure, when the owner is inside.

Another object of this invention is to provide a locking bar for doors, from the inside, which will be particularly adaptable for hollow doors, that have little wood in their structures, as the present invention will require enormous strength to be ruptured, when a person or persons are trying to break down the door upon which it is installed.

A further object of this invention is to provide a locking bar for doors, from the inside, which will include a cylinder lock, for preventing it from being removed from the door, except by authorized persons within the dwelling or other structure.

Other objects of the present invention are to provide a locking bar for doors, which is simple in design, inexpensive to manufacture, rugged in construction, easy to use and efficient in operation.

These, and other objects, will be readily evident, upon a study of the following specification, and the accompanying drawing, wherein.

Figure 1:
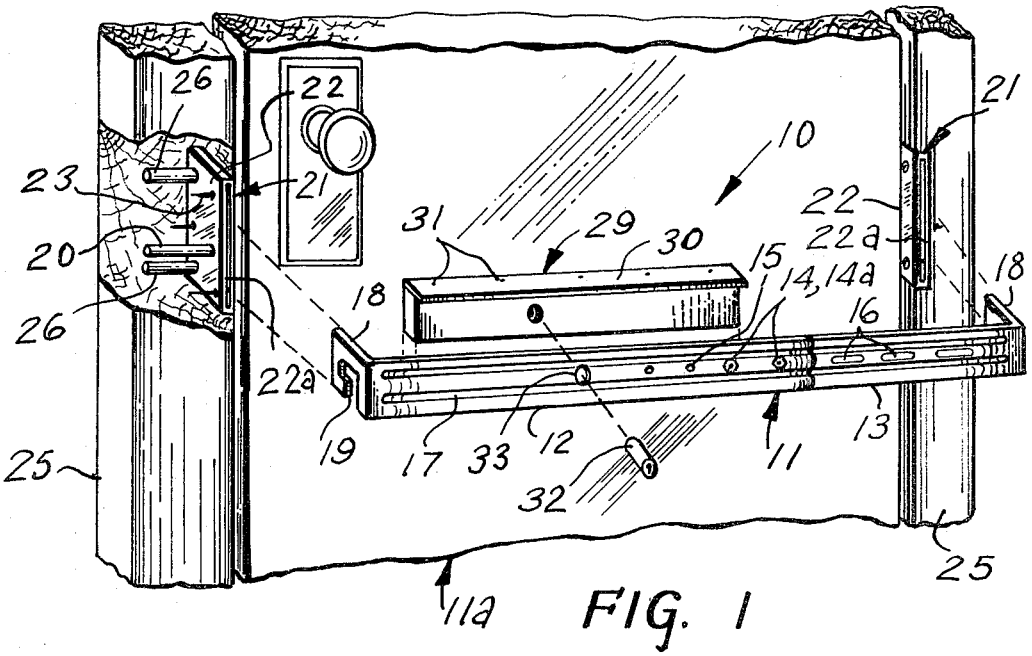
FIG. 1 is a perpective view of the present invention, shown partially exploded, with one door jamb of the door illustrated partly broken away.
Figure 2:
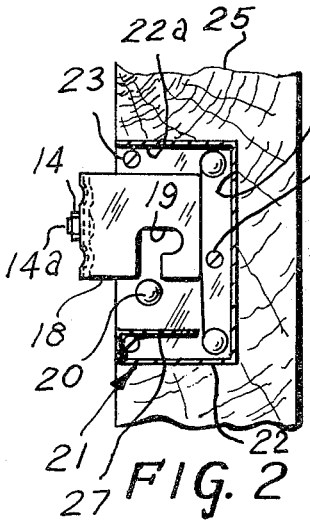
FIG. 2 is a fragmentary side view of the bar portion of the invention, shown prior to engagement with a pin of one of the door jamb receiving and latching devices.
Figure 3:
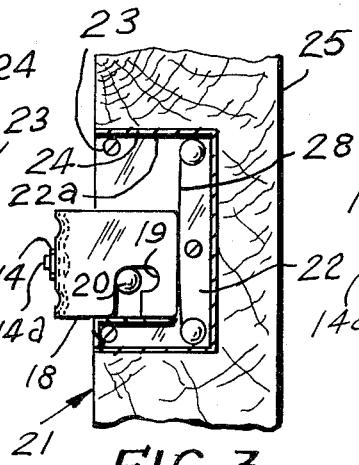
FIG. 3 is similar to FIG. 2, but illustrates the bar portion in the downward position, prior to full latching engagement.

According to this invention, device 10 is shown to include an adjustable length bar 11. Bar 11 includes one rail 12, which is slidable against a second rail 13. Rail 12 includes a pair of nut fasteners 14, and bolt fasteners 14*a*, the bolt fasteners 14*a* being removably received in openings 15 of rail 12 and the elongated openings 16 in rail 13, so as to adjust bar 11 to fit a door 11*a* of any width, and both rails 12 and 13 are beaded at 17, for maximum rigidity. A leg 18 integral with, and at right angles to, rails 12 and 13, includes an "L"-shaped slot 19 therethrough, for removably receiving a pin 20 in latch brackets 21. Latch brackets 21 consist of a rectangular plate 22, having an opening 22*a*, which extends from one longitudinal side edge to the other. Latch brackets 21 are secured by screw fasteners 23, within the recesses 24 of the door jambs 25.

It shall be noted, that one end of pins 20, and also pins 26, are fixedly secured to plates 22, and they extend through the slots 22*a*, and the opposite ends are imbedded within the door jambs 25, for providing maximum holding strength to bar 11, so as to prevent anyone from breaking down door 11*a*.

Figure 4:
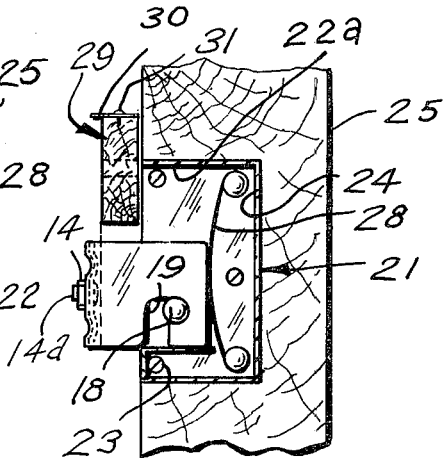
FIG. 4 is also similar to FIGS. 2 and 3, but shows the bar portion in full latching engagement, and illustrates the securement bar prior to being slipped into place.
Figure 5:
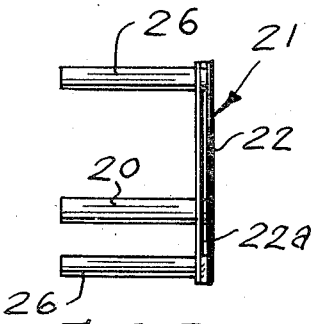
FIG. 5 is a side elevational view of the left door jamb latching device.
Figure 6:
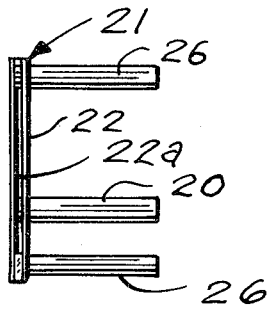
FIG. 6 is a side elevational view of the right door jamb latching device.

A platform 27, of "L"-shaped configuration, is fixedly secured within slots 22*a*, so as to enable the legs 18 of bar 11 to bottom on, when bar 11 is in latching engagement with latching brackets 21, and a leaf spring 28 is secured, at its ends, to the two pins 26 in each of the brackets 21, so as to springingly urge the ends of legs 18 outward of brackets 21, when pins 18 are in holding engagement with slots 19, as illustrated in FIG. 4 of the drawings.

It shall also be noted, that latching brackets 21 are installed flush with their respective door jambs 25, and a wooden bar 29, having a plate 30 secured to it by suitable fasteners 31, is placed between bar 11 and the door 11*a*, so as to provide a snug fit, and plate 30 overhangs one side of wooden bar 29, so as to abut with the top edge of bar 11.

A cylinder lock 32 is secured, in a suitable manner, within opening 33 of bar 11, so as to advance a reciprocal bolt into bar 29, to thus prevent the unauthorized removal of bar 11 from door 11*a*.

In use, after the user enters his dwelling, he inserts the legs 18 in their respective latching brackets 21. The user urges the legs 18 forward, against the springs 28 in brackets 21, and then urges the bar 11 downwards, which will engage the pins 18 within the short ends of slots 19, and when bar 11 is released by the user, the leaf springs of brackets 21 will urge against the legs 18, thus holding the pins 18 in their proper latching engagement within their respective slots 19. The bar 29 is then placed between bar 11 and the door 11*a*, after which, the locking cylinder is used by key means (not shown), to prevent the removal of bar 11.

While various changes may be made in the detail construction, it is understood that such changes will be within the spirit and scope of the present invention, as is defined by the appended claims.

What I now claim is:

1. A locking bar for doors, comprising, in combination, a pair of adjustable rails, a pair of latching brackets received in the door jambs, between which a door is supported for latching and holding said pair of adjustable rails against forceful pressure against the outside of said door, and a bar removably received between said pair of adjustable rails and said door for rendering said pair of adjustable rails secure in their latching engagement with said pair of latching brackets.

2. The combination according to claim 1, wherein each end of said pair of adjustable rails includes a right angle leg integral of an end, and each of said right angle legs is removably received in a slot extending through from one longitudinal side edge to the opposite longitudinal side edge of a plate comprising each of said pair of latching brackets, and said pair of latching brackets are, one each, secured by screw fastener and pin means in said door jambs.

3. The combination according to claim 2, wherein said pin means comprise a plurality, each of which is fixedly secured, at one end, to one side of said plates and each extends through the slot of said plates, and the opposite ends of said plurality of pins are fixedly secured in their respective door jamb cavities by suitable fastening means.

4. The combination according to claim 3, wherein one of said plurality of pins in each of said pair of latching brackets is removably received in an "L"-shaped slot in said legs for holding said pair of adjustable rails in place, and a leaf spring is secured, at each end, to a pair of said plurality of pins in said plates, and each of said leaf springs urges against the end of one of said respective legs, so as to keep said pair of adjustable rails in latched position.

* * * * *